US007578689B2

(12) United States Patent
Guan et al.

(10) Patent No.: US 7,578,689 B2
(45) Date of Patent: Aug. 25, 2009

(54) CARD EDGE CONNECTOR WITH LATCH

(75) Inventors: Hai-Fei Guan, Kunshan (CN); Xue-Wu Bu, Kunshan (CN); Ting-Shun Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/075,193

(22) Filed: Mar. 10, 2008

(65) Prior Publication Data

US 2008/0220637 A1 Sep. 11, 2008

(30) Foreign Application Priority Data

Mar. 9, 2007 (CN) ..... 2007 2 0035283

(51) Int. Cl.
*H01R 13/62* (2006.01)

(52) U.S. Cl. ..... 439/327; 439/629

(58) Field of Classification Search ..... 439/325–329, 439/357, 358, 629–637
See application file for complete search history.

(56) References Cited

U.S. PATENT DOCUMENTS 5,267,872 A * 12/1993 Gou et al. ..... 439/326
5,413,497 A * 5/1995 Lwee ..... 439/328
5,944,549 A * 8/1999 Po et al. ..... 439/326
6,616,466 B2 * 9/2003 Frantum et al. ..... 439/157
7,029,307 B1 * 4/2006 Ling et al. ..... 439/327
2008/0220637 A1 * 9/2008 Guan et al. ..... 439/157

* cited by examiner

*Primary Examiner*—James Harvey
(74) *Attorney, Agent, or Firm*—Wei Te Chung

(57) ABSTRACT

A card edge connector (100) for receiving a module (3) includes an elongated insulative housing (1) having a central slot (10) for receiving a bottom edge of the module and an arm portion (16) coupled to an end of the insulative housing. The arm portion includes a pair of side walls (160) with a retaining slot (168) formed therebetween for receiving a side edge of the module and a latch (17) located between the side walls and integrally extending upwardly from the insulative housing. The latch has a resilient arm (171) defining a retaining embossment (173) for latching the module and a gripping portion (172) for rotating the resilient arm. A number of terminals (2) are mounted on the insulative housing and extend into the central slot for electrical connection to the module.

16 Claims, 4 Drawing Sheets

CARD EDGE CONNECTOR WITH LATCH

BACKGROUND OF THE INVENTION

1. Field of the Invention

The present invention generally relates to a card edge connector for receiving a module and more particularly to a card edge connector having a latch for latching the module.

2. Description of Related Art

A conventional card edge connector is fixed in an electronic device such as a computer. Such card edge connector connecting between a mother board to which the card edge connector is mounted and a module which is received in the card edge connector usually comprises an elongated insulative housing, a plurality of terminals disposed therein and a pair of latches pivotably coupled to both lengthwise ends of the insulative housing. The insulative housing has a pair of side walls provided with an opening. The latches position the module in the insulative housing and remove the module from the insulative housing. Each latch has a pair of projections received in the complementary openings of the side walls thereby allowing the latches to rotate relative to the insulative housing. However, the conventional card edge connector has a pair of latches assembled to the insulative housing. Therefore, the number of the elements is increased which complicates the manufacture process of the card edge connector.

Hence, an improvement over the prior art is required to overcome the disadvantages thereof.

SUMMARY OF THE INVENTION

According one aspect of the present invention, a card edge connector for receiving a module comprises an elongated insulative housing having a central slot for receiving a bottom edge of the module and an arm portion coupled to an end of the insulative housing. The arm portion includes a pair of side walls with a retaining slot formed therebetween for receiving a side edge of the module and a latch located between the side walls and integrally extending upwardly from the insulative housing. The latch has a resilient arm defining a retaining embossment for latching the module and a gripping portion for rotating the resilient arm: A plurality of terminals are mounted on the insulative housing and extend into the central slot for electrical connection to the module.

According to another aspect of the present invention, a card edge connector comprises an elongated insulative housing and a plurality of terminals mounted on the insulative housing. The insulative housing has an elongate central slot for receiving a module, a pair of side walls integrally extending upwardly from the insulative housing with a retaining slot formed therebetween for retaining the module, and a latch extending integrally from the insulative housing and located between the side walls. Each side wall comprises an enlarged portion surrounding a top end of the latch. The latch has a resilient arm defining a retaining embossment for locking a notch on the module and a gripping portion for urging the resilient arm. The terminals extend into the central slot for electrical connection to the module.

These and additional objects, features, and advantages of the present invention will become apparent after reading the following detailed description of the preferred embodiment of the invention taken in conjunction with the appended drawings.

DETAILED DESCRIPTION OF THE INVENTION

Figure 1:
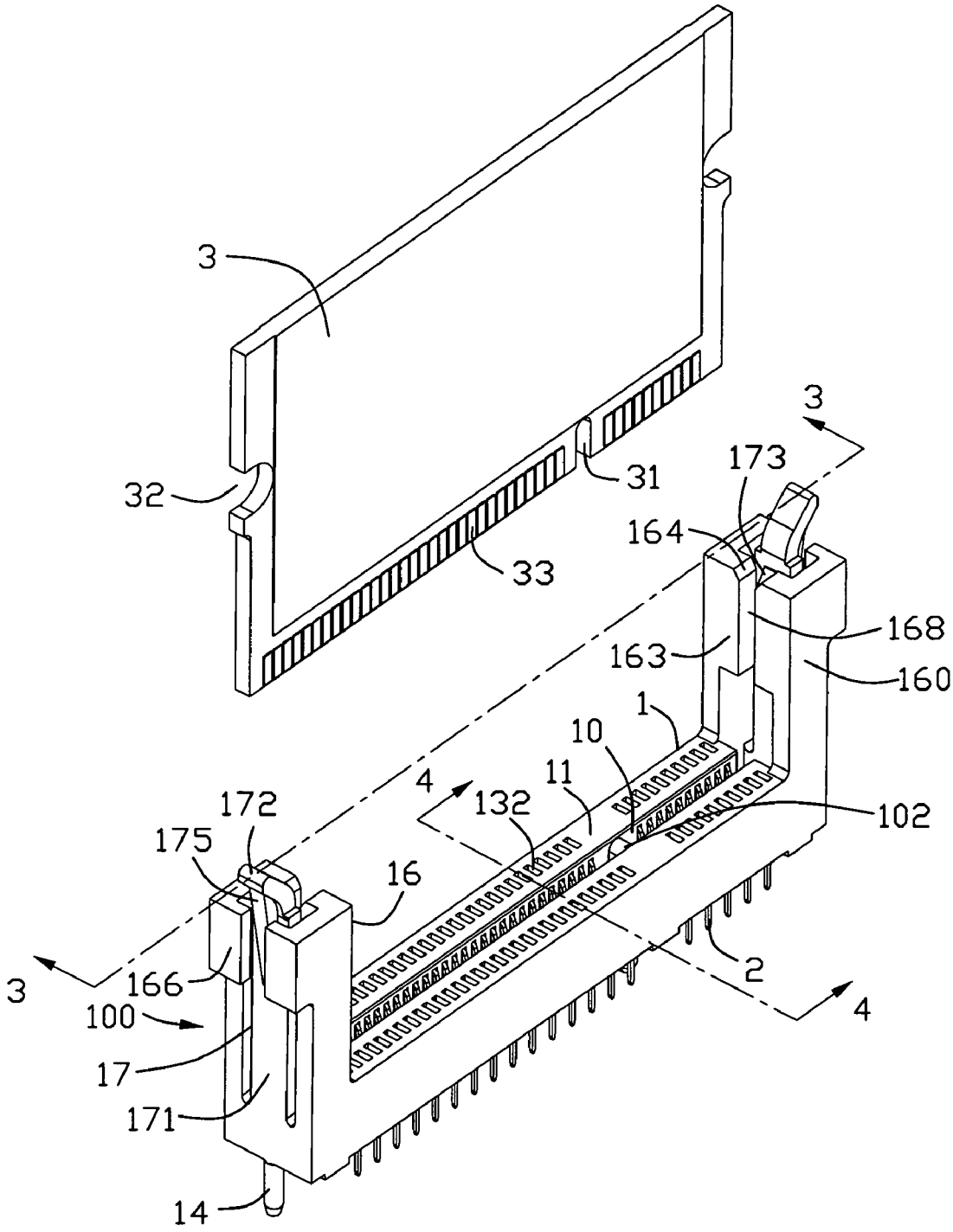
FIG. 1 is a perspective view of a card edge connector and a memory module received therein according to the present invention.

Reference will now be made to the drawing figures to describe the preferred embodiment of the present invention in detail.

Figure 3:
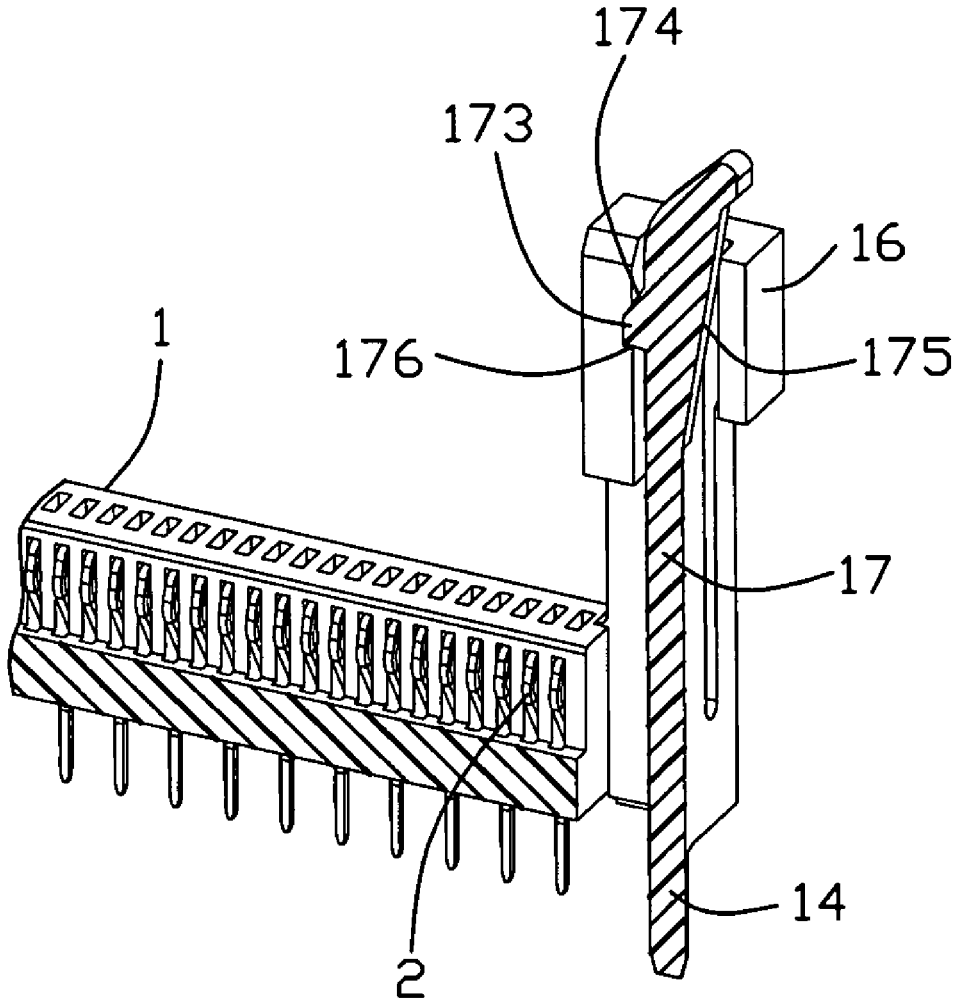
FIG. 3 is a partial perspective view of the card edge connector taken along line 3-3 in FIG. 1.

Referring to FIGS. 1 and 3, the card edge connector 100 according to the present invention is mounted on a printed circuit board (PCB) for receiving a memory module. The memory module 3 includes a pair of notches 32 on opposite sides thereof. The card edge connector 100 comprises an elongated insulative housing 1 and a plurality of terminals 2 mounted on the insulative housing 1. The insulative housing 1 has a top surface 11 and an elongated central slot 10 which is open to the top surface 11 for receiving a memory module 3. A protrusion 102 is formed in the central slot 10 for mating with a recess 31 on a bottom edge of the memory module 3. A plurality of cavities 132 are communicated with the central slot 10 for receiving the terminals 2. The insulative housing 1 has a pair of posts 14 extending downwardly from a bottom surface thereof. A pair of arm portions 16 are integrally extending upwardly from opposite ends of the insulative housing 1. Each arm portion 16 includes a pair of side walls 160 with a retaining slot 168 formed therebetween for retaining a side edge of the memory module 3.

A latch 17 is located between the side walls 160 and has a resilient arm 171 defining a retaining embossment 173 for latching the notch 32 of the memory module 3 and a gripping portion 172 for rotating the resilient arm 171. The retaining embossment 173 has a guiding face 174 for facilitating insertion of the memory module 3 and a retaining face 176 for restraining upward movement of the memory module 3. The gripping portion 172 extends upwardly from the resilient arm 171 and beyond the side walls 160. A rib 175 is provided at an outside of the latch 17 and connects with the resilient arm 171 and the gripping portion 172 so as to increase intensity of the gripping portion 172 while the gripping portion 172 is pulled outwardly. Each side wall 160 has an enlarged portion surrounding a top end of the latch. The enlarged portion includes a guiding portion 163 protruding into the retaining slot 168 for holding the memory module 3 and a backstop 166 formed at an outward location of the latch 17. The guiding portion 163 locates inside the latch 17 and has an oblique face 164 for guiding the memory module 3 inserted into the retaining slot 168.

Figure 2:
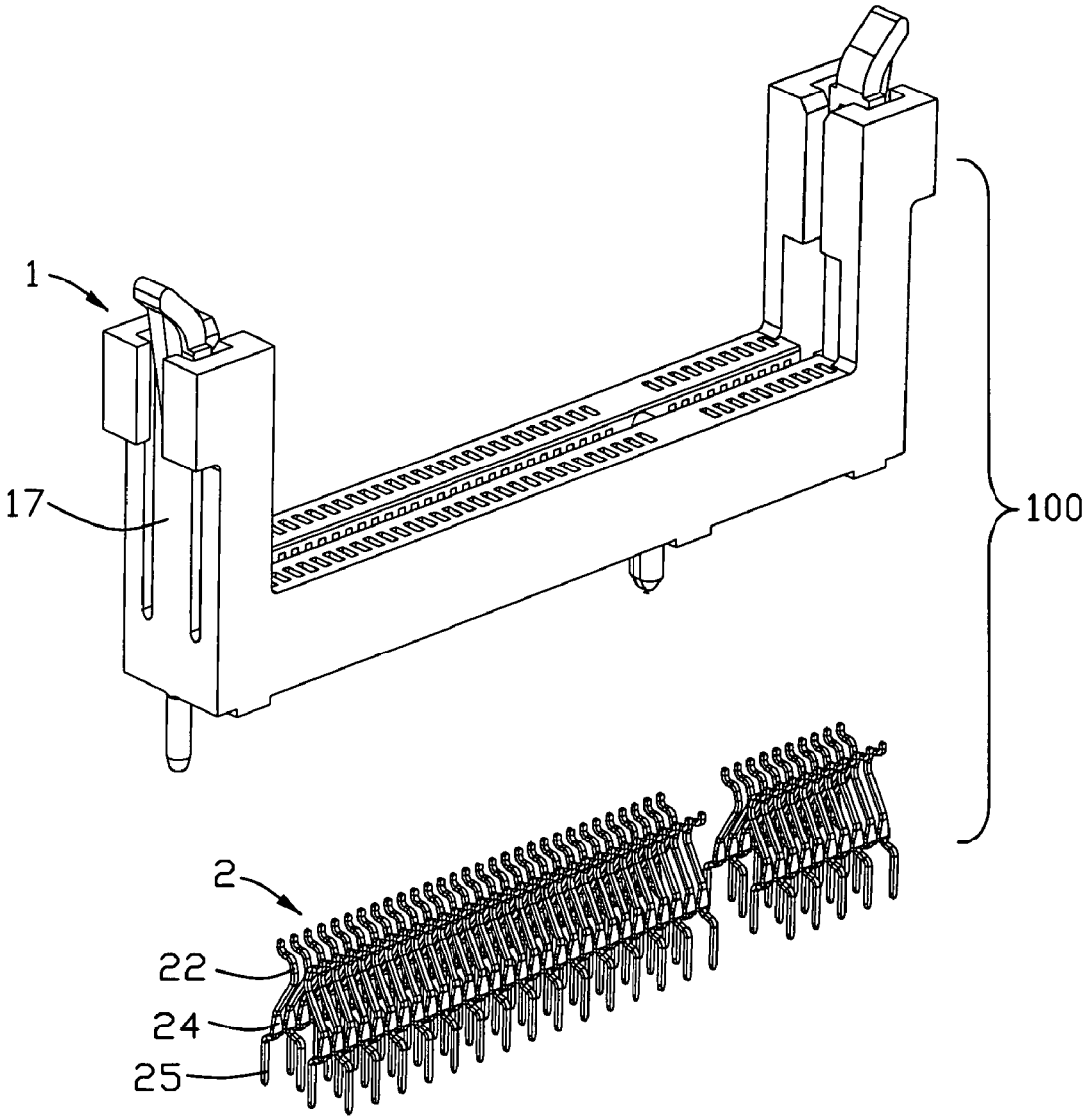
FIG. 2 is an exploded view of the card edge connector shown in FIG. 1.
Figure 4:
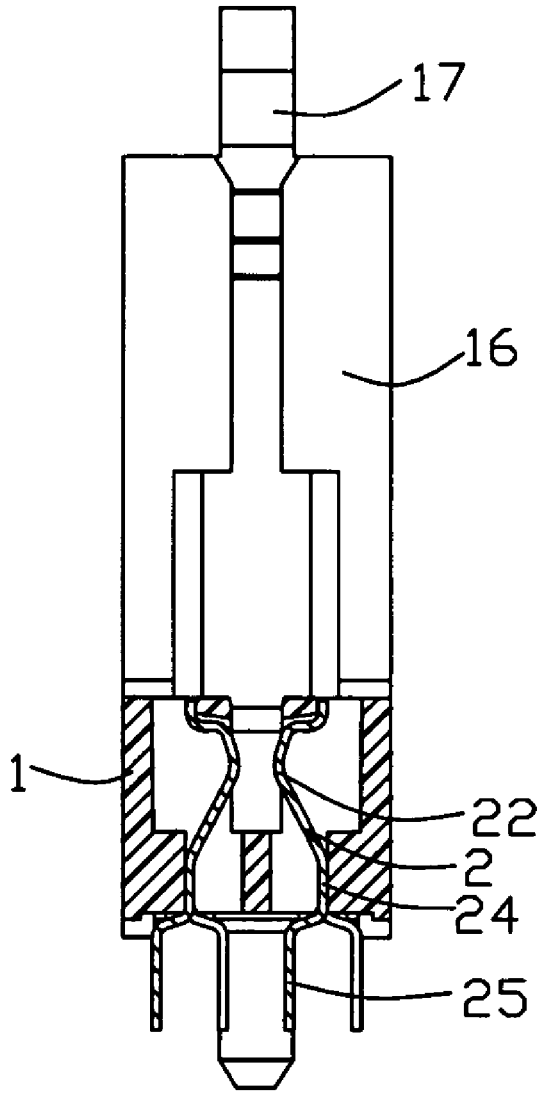
FIG. 4 is a cross-sectional view of the card edge connector taken along line 4-4 in FIG. 1.

Referring to FIGS. 2 and 4, each terminal 2 includes a contact portion 22 extending into the central slot 10 for engaging with a corresponding contact pad 33 on the memory module 3, a tail portion 25 projecting out of the insulative housing 1 for soldering to the printed circuit board, and a connecting portion 24 connecting with the contact portion 22 and the tail portion 25.

Referring to FIG. 1, in assembling the memory module 3 to the card edge connector 100, the bottom edge of the memory module 3 is firstly inserted into the retaining slots 168 guided by the oblique faces 164 of the side walls 160 and the guiding faces 174 of the retaining embossments 173. After assembling, the bottom edge of the memory module 3 is received in the central slot 10 and the protrusion 102 in the slot 10 mates with the recess 31 on the memory module 3 so as to prevent them from mismating. Meanwhile, the side edges of the memory module 3 are retained in the retaining slot 168 and the notches 32 are latched by the retaining embossments 173. The memory module 3 is thus firmly retained in the card edge connector 100.

When the memory module 3 is removed from the card edge connector 100, the gripping portions 172 are pulled outwardly so that the embossments 173 release the memory module 3. When the gripping portions 172 are pulled outwardly, the movement of each of the latch 17 will be limited by the corresponding backstop 166. When the gripping portions 172 are released and go back to the original position, the guiding portions 163 will limit inward movement of the latches 17.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for receiving a module, comprising:

an elongated insulative housing having a central slot for receiving a bottom edge of the module and an arm portion coupled to an end of the insulative housing, said arm portion including a pair of side walls with a retaining slot formed therebetween for receiving a side edge of the module, and a latch located between the side walls and integrally extending upwardly from the end of the insulative housing, said latch having a resilient arm defining a retaining embossment for latching the module and a gripping portion for rotating the resilient arm, the side walls having a pair of guiding portions protruding into the retaining slot for restraining the module therebetween and located inside the latch for limiting inward movement of the latch; and a plurality of terminals mounted on said insulative housing and extending into the central slot for electrical connection to the module.

2. The card edge connector as claimed in claim 1, wherein said gripping portion integrally extends upwardly and outwardly from free end of the resilient arm.

3. The card edge connector as claimed in claim 2, wherein said gripping portion is higher than the side walls.

4. The card edge connector as claimed in claim 1, wherein said latch has a rib outside thereof and connects with the resilient arm and the gripping portion.

5. The card edge connector as claimed in claim 1, wherein said retaining embossment has a guiding face for facilitating insertion of the module and a retaining face for restraining upward movement of the module.

6. A card edge connector comprising:

an insulative housing defining a central slot along a longitudinal direction of the housing;

a plurality of terminals disposed in the housing and located at two sides of the central slot; and a pair of towers formed at two opposite longitudinal ends of the housing, each of said towers including a pair of spaced U-shaped upper sections upwardly extending along two side walls of the housing, and a deflectable latch upwardly extending along an end wall of the housing;

wherein two opposite lateral edges of the latch are restrictively confined between said pair of U-shaped upper sections in both the longitudinal direction and a transversely direction perpendicular to said longitudinal direction.

7. The card edge connector as claimed in claim 1, wherein each of the side walls has a backstop formed at an outward location of the latch for limiting an outward movement of the latch.

8. A card edge connector, comprising:

an elongated insulative housing having an elongate central slot for receiving a module, a pair of side walls integrally extending upwardly from the insulative housing with a retaining slot formed therebetween for retaining the module, and a latch extending integrally from an end of the insulative housing and located between the side walls, each side wall comprising an enlarged portion surrounding a top end of the latch, the enlarged portions comprising a pair of guiding portions protruding into the retaining slot for restraining the module therebetween and located at an inward location of the latch, said latch having a resilient arm defining a retaining embossment for locking a notch on the module and a gripping portion for urging the resilient arm; and a plurality of terminals mounted on said insulative housing and extending into the central slot for electrical connection to the module.

9. The card edge connector as claimed in claim 8, wherein said gripping portion is higher than the side walls and integrally extends obliquely from the resilient arm.

10. The card edge connector as claimed in claim 8, wherein said latch has a rib at the top end thereof.

11. The card edge connector as claimed in claim 8, wherein the enlarged portion comprises a backstop formed at an outward location of the latch for limiting an outward movement of the latch.

12. The card edge connector as claimed in claim 6, wherein said deflectable latch is operated via resiliency thereof between locking and unlocking positions.

13. The card edge connector as claimed in claim 6, wherein the U-shaped upper section restrains the latch from back and forth moving in said longitudinal direction.

14. The card edge connector as claimed in claim 6, wherein said pair of U-shaped upper sections are spaced from each other with a gap therebetween, and each of said deflectable latch defines a locking embossment extending toward the central slot in said longitudinal direction and is essentially located in said gap.

15. The card edge connector as claimed in claim 14, wherein said deflectable latch has a resilient arm defining a gripping portion for rotating the resilient arm, the locking embossment is formed on the resilient arm, said latch has a rib connecting with the resilient arm and the gripping portion and essentially located in said gap.

16. the card edge connector as claimed in claim 6, wherein the latch integrally and upwardly extends from the end wall.

* * * * *